US006591514B2

(12) United States Patent
Kristensen

(10) Patent No.: US 6,591,514 B2
(45) Date of Patent: Jul. 15, 2003

(54) CENTRIFUGE FOR DRAINING WASHED EGG TRAYS

(75) Inventor: Jens Kristian Sønderby Kristensen, Odense SØ (DK)

(73) Assignee: Sanovo Engineering A/S, Odense SV (DK)

( * ) Notice: Subject to any disclaimer, the term of this patent is extended or adjusted under 35 U.S.C. 154(b) by 0 days.

(21) Appl. No.: 10/043,235

(22) Filed: Jan. 14, 2002

(65) Prior Publication Data

US 2002/0133966 A1 Sep. 26, 2002

Related U.S. Application Data

(60) Provisional application No. 60/271,421, filed on Feb. 27, 2001.

(30) Foreign Application Priority Data

Jan. 15, 2001 (DK) ..... 2001 0062
Jan. 16, 2001 (DK) ..... 2001 00071

(51) Int. Cl.[7] ..... F26B 17/24

(52) U.S. Cl. ..... 34/58; 34/105; 34/106; 34/236

(58) Field of Search ..... 34/58, 103, 104, 34/105, 106, 236; 261/83; 239/215, 223

(56) References Cited

U.S. PATENT DOCUMENTS

| | | | | |
|---|---|---|---|---|
| 3,257,732 A | | 6/1966 | Webster | |
| 4,064,635 A | | 12/1977 | Kuhl | |
| 4,134,215 A | | 1/1979 | Kuhl | |
| 4,241,866 A | | 12/1980 | Giesbert et al. | |
| 4,313,266 A | * | 2/1982 | Tam | 34/317 |
| 4,461,096 A | * | 7/1984 | Suzuki | 34/573 |
| 4,464,846 A | | 8/1984 | Itoh et al. | |
| 4,493,156 A | * | 1/1985 | Siegmann | 34/319 |
| 4,593,479 A | | 6/1986 | Pignal et al. | |
| 4,702,777 A | | 10/1987 | Kuhl | |
| 5,212,876 A | | 5/1993 | Berit | |
| 5,647,140 A | | 7/1997 | Hudspeth | |
| 6,269,552 B1 | * | 8/2001 | Honda | 34/317 |

FOREIGN PATENT DOCUMENTS

| | | |
|---|---|---|
| DE | 41 40 989 A1 | 7/1992 |
| EP | 0 301 183 A2 | 5/1988 |
| EP | 0 578 064 A1 | 1/1994 |
| EP | 0 861 689 A2 | 10/1997 |
| EP | 1 154 214 A1 | 11/2001 |
| FR | 2 677 561 | 12/1992 |
| GB | 2 174 974 A | 11/1986 |
| WO | WO 95/14371 | 6/1995 |

OTHER PUBLICATIONS

Patent Abstracts of Japan; Publication No. 10080670; Mar. 31, 1998; Nakai Kogyo, K.K.

* cited by examiner

*Primary Examiner*—Ira S. Lazarus
*Assistant Examiner*—Kathryn S. O'Malley
(74) *Attorney, Agent, or Firm*—Sughrue Mion, PLLC

(57) ABSTRACT

A centrifuge for draining washed egg trays comprises a centrifuge chamber in a housing (9). A bottom (8) for receiving a washed stack (7) of egg trays in a feeding position is displaceable with respect to said housing (9) between the feeding position and a centrifuging position. The stack (7) of egg trays is centred on the bottom in the centrifuging position, and in this position the bottom is in engagement with a rotational drive (22, 23), which is vertically non-displaceable with respect to the housing.

17 Claims, 5 Drawing Sheets

CENTRIFUGE FOR DRAINING WASHED EGG TRAYS

CROSS-REFERENCE TO RELATED APPLICATIONS

The present application claims the benefit of priorities from Danish Patent Application No. PA 2001 00062 filed on Jan. 15, 2001, and from Danish Patent Application No. PA 2001 00071 filed on Jan. 16, 2001, and from U.S.A Provisional Patent Application No. 60/271,421 filed on Feb. 27, 2001.

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

The present invention relates to a centrifuge for draining washed egg trays, comprising a centrifuge chamber in a housing, a bottom, means for holding the trays, and a drive for rotating the trays, said bottom and said housing being mutually displaceable between a feeding position in which the bottom is level with a feeding conveyor for wet egg trays, and a centrifuging position for egg trays enclosed in the centrifuge chamber of the housing.

The use of such centrifuges for draining egg trays are known from the U.S. Pat. Nos. 4,064,635 and 4,134,215. The egg trays are moved individually one after another through a washing station, and after washing, the individual egg tray is placed on a rotational drive part, and the drive part and egg tray are displaced vertically into the centrifuge chamber, and the single egg tray is centrifuged. After centrifuging the egg tray is moved to a stacking device. These centrifuges have to perform a full working cycle for each egg tray, and this consumes both time and energy. It is also a disadvantage that the egg tray is located at a maximum distance from the drive motor of the centrifuge when in the centrifuging position.

From U.S. Pat. No. 4,702,777 is known a dual-stack combined washing and centrifuging chamber, which is filled manually by an operator carrying stacks of trays over to the centrifuge and filling and emptying it. The prior-art centrifuge is designed as a separate unit in relation to the remainder of the washing line. Both the manual filling and the separation from the remainder of the production line result in extensive handling of the trays, which increases the risk of dirtying the trays just washed clean. In efficient washing lines the centrifuging may be a capacity-limiting part of the production line. The combination of washing and centrifuging into the same unit further limits the capacity of the unit. In this prior art combined washing and centrifuging unit the bottom is non-displaceable with respect to the housing, and the feeding and centrifuging positions are identical and the same as the washing position.

BRIEF SUMMARY OF THE INVENTION

It is an object of the invention to provide an automatically functioning centrifuge of relatively high capacity for building in as an integral part of the production line.

This object is obtained by a centrifuge according to the invention characterized in that a stack of washed egg trays can be positioned on the bottom, that the stack of egg trays is centred on the bottom in the centrifuging position, and that, in said centrifuging position, the bottom is in engagement with said rotational drive which is vertically non-displaceable with respect to the housing.

Because the centrifuge is associated with a feeding conveyor and the bottom is at the same level as the bottom of the conveyed stacks, another stack can be fed mechanically and automatically onto the bottom of the centrifuge without the use of complex transfer mechanisms. This facilitates integration of the centrifuge in a production line and reduces the risk of erroneous positioning of stacks, which is of importance for achieving large capacity in the line. In view of operational reliability, it is an advantage that the bottom and the housing of the centrifuge have to be mutually moved after a wet stack of egg trays has been positioned and before centrifuging is initiated. During the mutual movement, the stack can be correctly adjusted in terms of centring and angular position in relation to the holding means and can be held in a suitable centrifuging position with the centre axis of the tray being substantially coaxial with the axis of rotation of the centrifuge.

In the feeding position, the centrifuge is in an open condition with access to sideways displacement of a stack of trays onto the bottom, and in the centrifuging position the centrifuge is in a closed condition, the housing enclosing the bottom and the stack. The mutual movement between bottom and housing may, for example, be made by moving the housing in relation to the bottom or by moving the bottom in relation to the housing. The movement between the two positions may suitably be a vertical displacement of the bottom and/or housing of the centrifuge, as the centrifuge may then have a substantially vertical axis of rotation. When the draining has been concluded, the centrifuge is opened by repeating the displacement carried out in connection with the closure in the opposite direction, and the stack is pushed out.

In the centrifuging position the bottom engages with a rotational drive for the bottom mounted so as to be vertically non-displaceable in relation to the housing. The vertical fixing of the drive gives the centrifuge a simple design, particularly if the bottom is vertically displaceable and, for example, made to engage with the drive at the end of the movement into the centrifuging position.

The means for holding the trays can rotationally fix the stack to the bottom during centrifuging, and suitably the means are movable in relation to the bottom BO that in the feeding position the means can be in a withdrawn position providing free passage for stacks of trays to and from the bottom.

In a preferred embodiment, elongated guides are mounted on a cover for upward closing of the centrifuge chamber, the ends of the guides opposite the cover having carriers for gripping and lifting the bottom, and in the centrifuging position the carriers are suitably located under the bottom with a clearance up to its lower surface. The movements of the cover and the bottom can thus be made by a single drive moving cover, guides and bottom in joint movements.

The centrifuge is suitable for building into a conveyor line so that it is located between the feeding conveyor and a discharge conveyor and so that at the feeding position a feeding opening faces sideways and is open towards the feeding conveyor, and a discharge opening faces sideways and is open towards the discharge conveyor.

Building in the centrifuge as an integral part of the system results in saving of the time otherwise to be spent on moving the stacks between the washing line itself and the centrifuge.

It is advantageous to feed a stack for accurate positioning on the bottom, thus minimising or avoiding subsequent adjustments of the stack position. In one embodiment, the still wet stack is pushed into the centrifuge by means of a pushing mechanism arranged in or in connection with the feeding conveyor, which mechanism suitably pushes the stack a well-defined distance that positions the stack in an end position which is centred in relation to the bottom.

To simplify the passage of stacks to and from the conveyors, the centrifuge preferably has a stop device that can stop the rotational movement of the bottom at one or more predetermined positions corresponding to a stack side surface facing in the discharge direction.

In an embodiment of the centrifuge the means for holding the trays comprise holders formed as upright rods located in the housing and fixed to a drive shaft in the rotational drive, and that in the centrifuging position the upright rods are located at each of the four corners of the stack. The upright rods at each corner of the stack provide secure holds on the stack along the complete height of the stack.

It is an advantage of the centrifuge that in the centrifuging position the stack can be closer to the drive motor of the rotational drive than in the feeding position because the drive will be subjected to less forces during centrifuging. This advantage is enhanced when displacement of the bottom in the height direction of the stack between the feeding and centrifuging positions is of considerable length in order to accommodate for high stacks.

BRIEF DESCRIPTION OF THE SEVERAL VIEWS OF THE DRAWING

A preferred embodiment of the invention is described in more detail below by means of the figures of the drawing, in which:

FIG. 1 is an outline of a system in which the centrifuge according to the invention is built in.

DETAILED DESCRIPTION OF THE INVENTION

Figure 1:
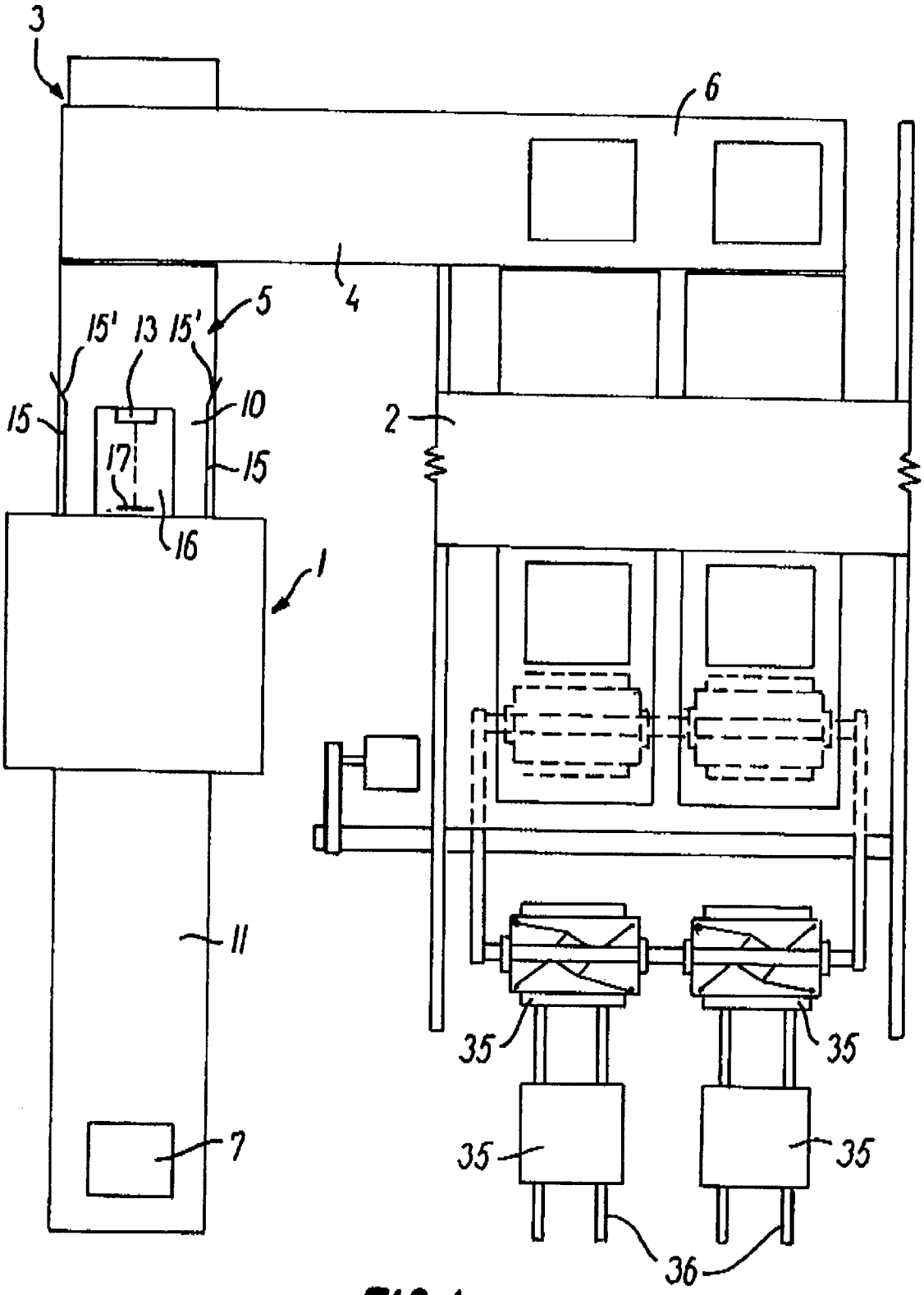

In the embodiment depicted in FIG. 1, a centrifuge 1 is used in a washing plant for egg trays. The plant is shown with a U-shaped conveyor course for operation by just a single person standing at the open end of the U. If the capacity of the washing machine 2 itself is expanded or the speed is otherwise increased, several centrifuges arranged in parallel can be used, the stacks being divided between several centrifuge lines. Division of the flow of stacks from the washing plant may, for example, be done at the bend 3 of the conveyor sections 4, 5 between the washing plant and the centrifuge. This is also where the speed at which the stacks are fed to the centrifuge is controlled, the section 4 downstream of a restacking unit 6 being able to function as a buffer. The centrifuge according to the invention can also be arranged elsewhere downstream of the restacking unit 6, such as at a bend in the production line, but this is less preferred as the below-mentioned pushing out by means of the next stack is not practicable in that case.

Figure 2A:
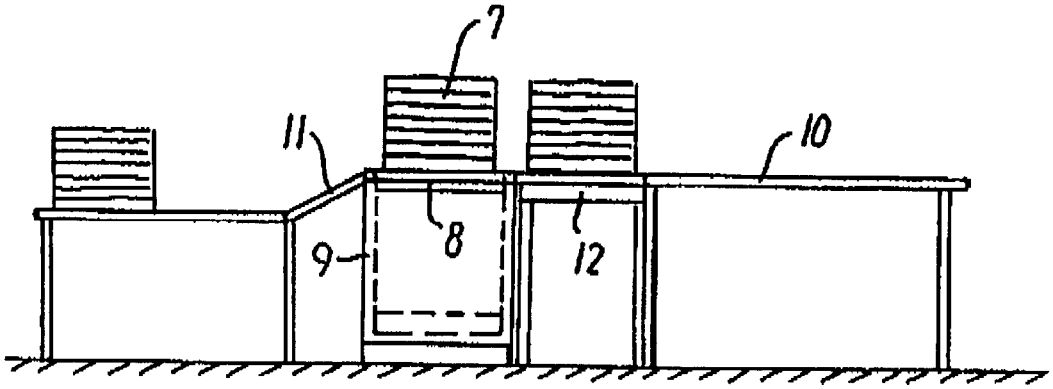
FIGS. 2*a* to 2*c* depict three different embodiments of the type of centrifuge in an open condition, the closed condition being shown by a dashed line.
Figure 2B:
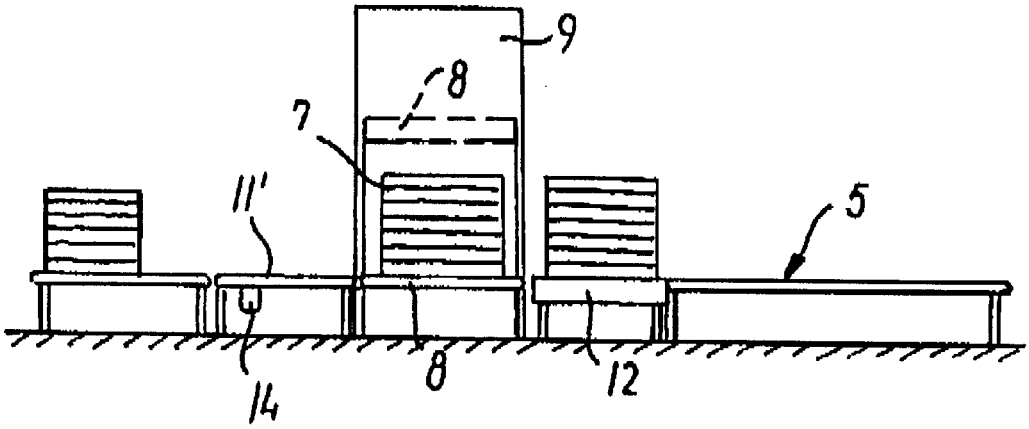
Figure 2C:
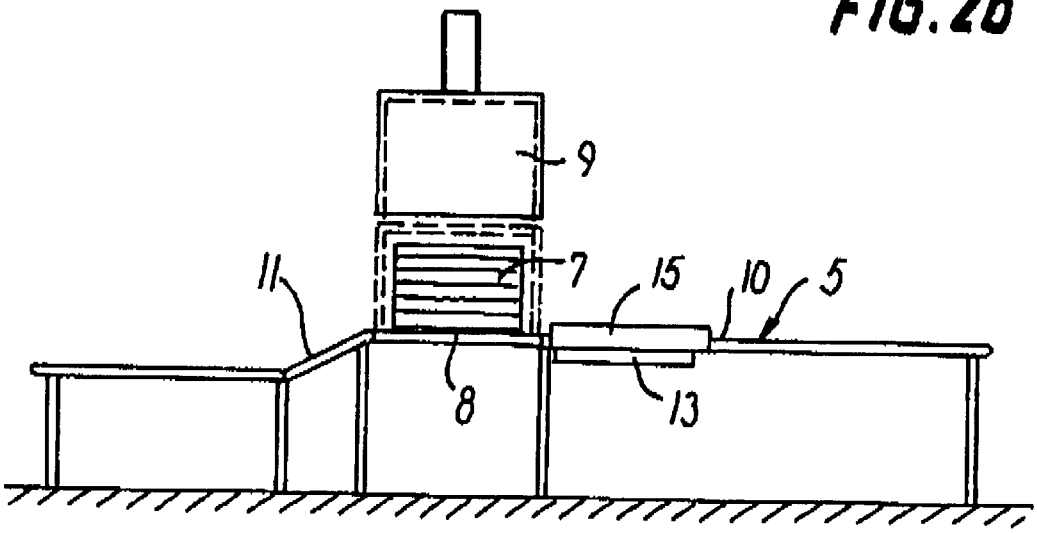

FIGS. 2*a* to 2*c* outline three different embodiments all having a centrifuge with two end positions, one being the completely open feeding position (shown in solid lines), the other being the closed centrifuging position (shown in dashed lines). FIG. 2*a* shows an embodiment in which tray stacks 7 are brought into place in the centrifuge by lowering of the centrifuge bottom 8, which is level with the upper edge of a shielding housing 9 in the feeding position. This embodiment is the one described below as the preferred one. In the following description of other embodiments, details with the same function will, for the sake of ease, be designated with the same numerals.

In FIG. 2*b*, the bottom 8 and the components located below it are lowered relative to the housing 9, which remains stationary, providing space for the feeding of tray stacks 7. FIG. 2*c* shows a solution similar to the one in FIG. 2*b*, but where, instead, the housing 9 is vertically displaceable in relation to the bottom 2.

Figure 3:
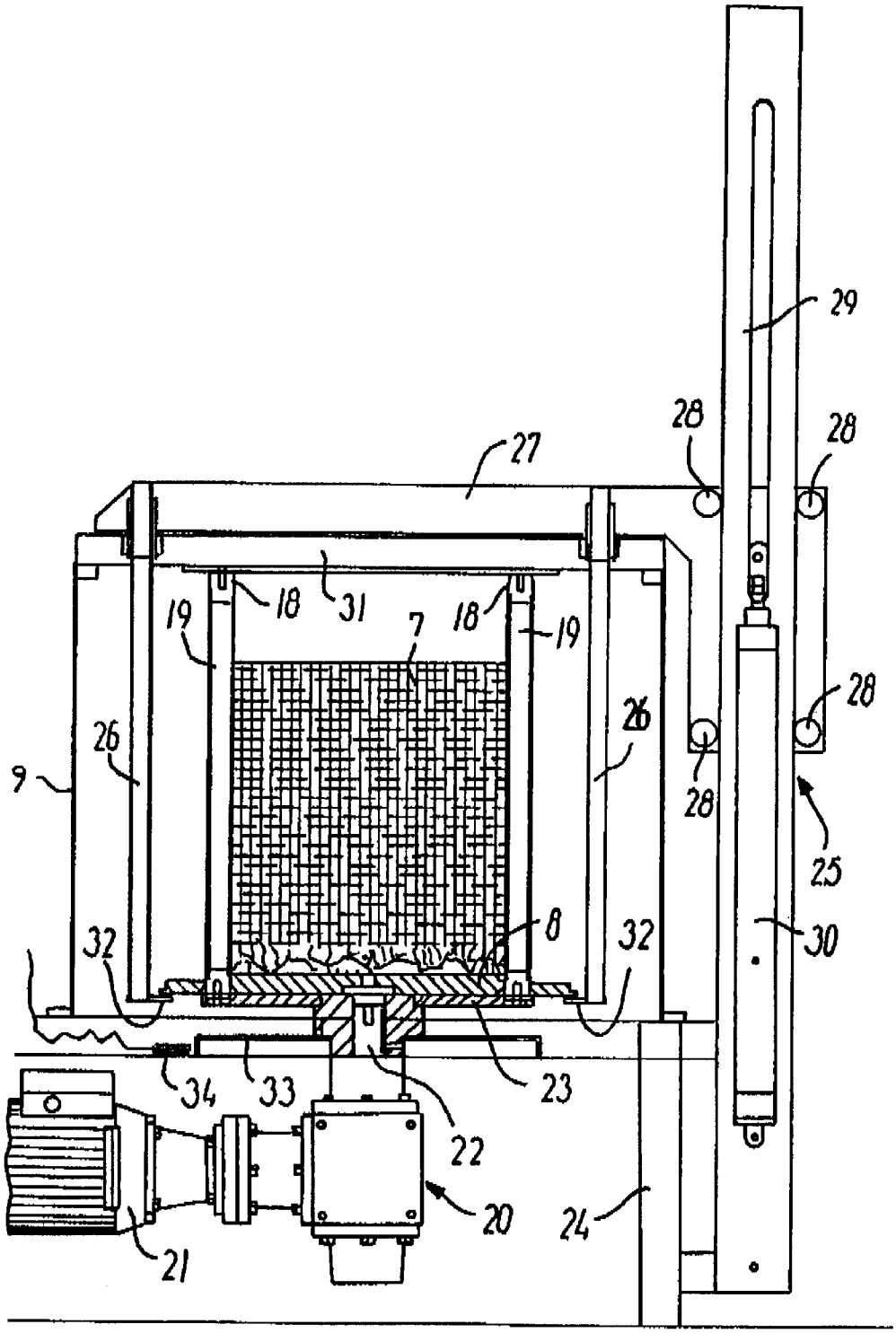
FIGS. 3 and 4 depict the centrifuge of FIG. 2*a* in the closed and open condition, respectively.
Figure 4:
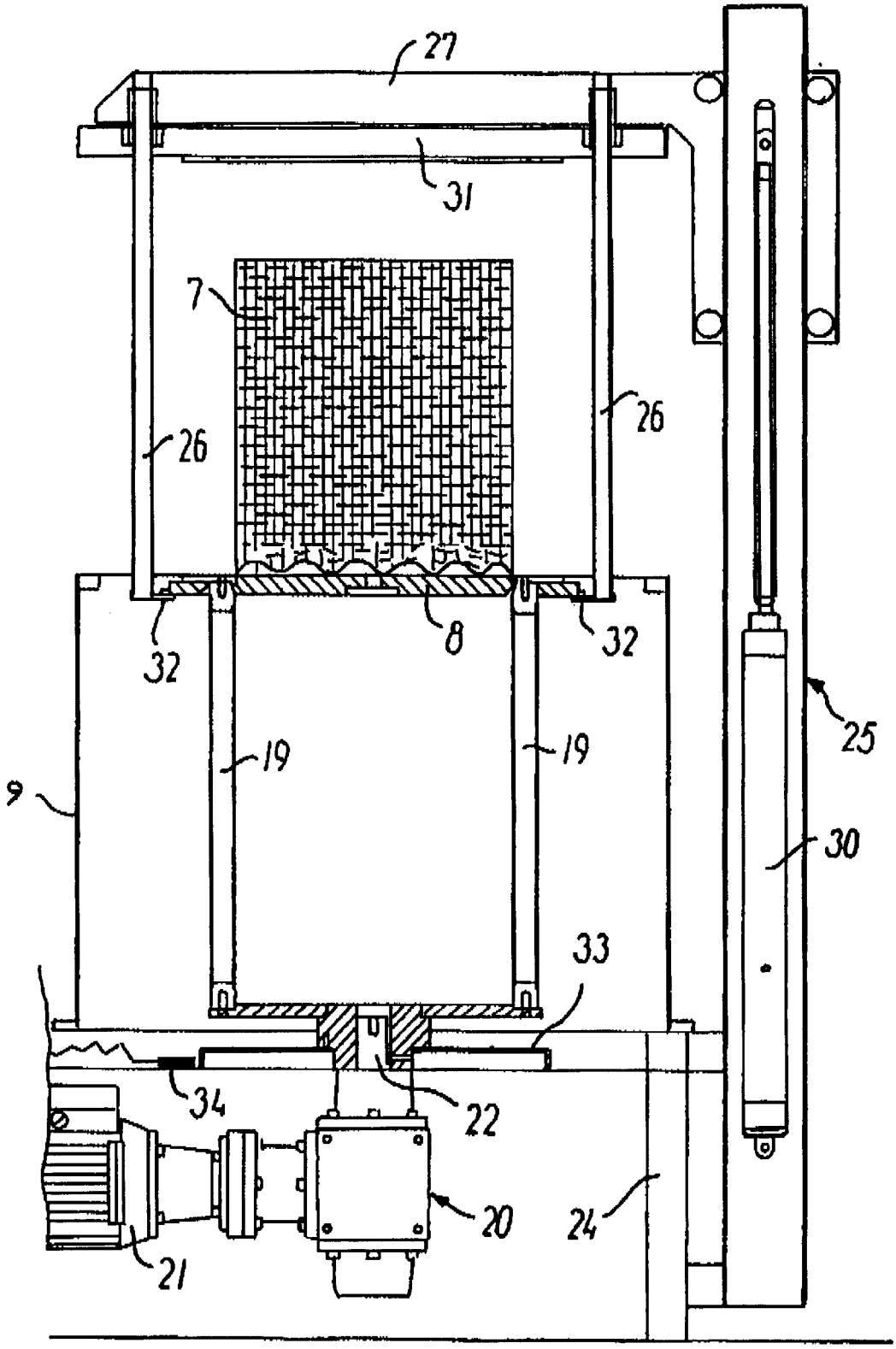

The preferred embodiment of the centrifuge, which is shown in outline in FIG. 2*a*, is shown in more detail in FIGS. 3 and 4.

The conveyor sections conveying the stacks of trays to and from the centrifuge can be designed in different ways. As shown in the drawing, the tray stacks 7 are preferably fed mechanically into the centrifuge by the feeding conveyor in an unbroken, rectilinear movement, the centrifuge being placed at the end of a feeding conveyor 10, as shown in FIGS. 1 and 2*c*, although, as shown in FIGS. 2*a* and 2*b*, a waiting space 12 with a separate pusher may be provided in the end section of the feeding conveyor.

After completed centrifuging, the tray stacks 7 are conveyed away via a discharge conveyor 11 arranged in continuation of the centrifuge in the line just mentioned so that the feeding of another stack results in the stack just drained being pushed out on to the discharge conveyor. By designing the discharge conveyor with a drop as shown in FIGS. 2*a* and 2*c*, the stack just drained rolls off by itself when its point of gravity has been pushed over the downwardly inclined part of the discharge conveyor. In the embodiment of FIG. 2*b*, the first section of the discharge conveyor is formed as a conveyor belt driven by a motor 14. This makes it possible to place the discharge conveyor at the same horizontal level as the bottom 8 in the feeding position.

Using the new stack to push the stack just drained out of the centrifuge provides the advantage that separate means for pushing out the trays are not necessary. However, this method presupposes that the stacks not yet drained are oriented uniformly on the conveyor 10 and that the front side of the stack is substantially at right angles to the forward direction of the conveyor. This uniformity can be ensured, for example, by means of two plate-shaped side guides 15 projecting over the supporting surface of the conveyor and having a first section 15', in which they extend obliquely funnel-like towards the middle of the conveyor until they extend into a course parallel with the centre line of the conveyor, in which the distance between the side guides is only slightly larger than the width of the stack of egg trays, as shown in FIGS. 1 and 2*c*.

In the preferred embodiment, another stack is fed into the centrifuge by means of a pushing mechanism 13 arranged at the end of the feeding conveyor 10 closest to the centrifuge. On the section where the pushing mechanism 13 is working, a recess 16 is arranged in the middle of the conveyor to give the pushing mechanism free access to the lower transverse edge of the stack approximately at the middle of the edge.

The actual pushing mechanism 13 may, for example, comprise a pin 17 which is pushed upwards behind the stack at actuation of the mechanism and pushed forwards by means of a pneumatic driving cylinder, The push preferably has a predetermined length corresponding to the pin being located half a stack length from the centre of the bottom 8, so as to ensure that the stack will be positioned accurately in the centrifuge. As an alternative to the pushing mechanism 13, the feeding conveyor 10 may in itself have such force that it can push the stack of trays into the centrifuge. In that case, however, it will be necessary to use means, such as sideways withdrawable end stops, to stop the forward movement of the stack when the stack is exactly in the desired end position on the bottom 8.

If no side guides 15 or other centring means effective during the pushing in of a stack on the bottom 8 are used, means may be adapted to ensure that the stack will be correctly positioned in the centrifuge chamber in connection with the closing of the centrifuge. In FIG. 3, as an example of such means, oblique guide surfaces 18 are formed at the top of upright rods or holders 19 fixed to a rotational drive 20 comprising a drive motor 21 and a shaft 22 driven by the motor and with a rigidly mounted supporting plate 23 to which the vertical upright holders are fixed. The holders 19 project through holes in the movable bottom 8. This design ensures that the holding means are not in the way of either filling or emptying of the centrifuge while forming a firm rotational engagement between the bottom 8 and the rotational drive 20 during the centrifuging, when the stack of egg trays is furthermore held in relation to the bottom by means of the holders 19. The number and position of the holders 19 can be adapted to the current type of tray. Typically four holders arranged at the tray corners can be used, but if the trays have notches in their sides, it is also possible to place the holders in these notches, such as at the middle of the side surfaces of the trays. By means of a supporting consol, not shown, the rotational drive is fastened vertically non-displaceably to the centrifuge frame 24 standing on the floor.

In the preferred embodiment, the bottom 8 is raised and lowered by means of a special lifting device 25 which, as shown in FIGS. 3 and 4, is formed as a system of four rods or guides 26 projecting downwards from the horizontal stiffener of an L-shaped yoke 27 which on its vertical stiffener carries guide wheels 28 running on opposite sides of a vertical guide column 29. Obviously, other orientations than vertical can also be used for the guide column as long as it is substantially parallel with the lifting direction for the bottom 8. The yoke 27 is connected with the upper end of a driving cylinder 30 whose lower end is fixed to the guide column.

At the top, the guides 26 support a cover 31 for upward closing of the centrifuge chamber. At their lower ends, the guides have carriers 32 projecting radially under the bottom 8 to grip and lift the bottom when the yoke 27 is raised to the feeding position shown in FIG. 4. When the driving cylinder is actuated to its lower position where the bottom 8 is in its centrifuging position, there is a clearance between the carriers and the lower surface of the bottom, eliminating the risk of friction between carriers and bottom during centrifuging. During centrifuging, the lifting device 25, which is firmly connected to the cover 31, remains stationary.

Alternatively, the lifting device may act from below. However, this is less preferred, as such a device has to share the space below the centrifuge with the centrifuge drive and the positioning device, Moreover, two separate drive mechanisms may be needed to move the cover 31 and the lifting device 25.

Whether pushing out by means of the next stack or a separate mechanical pusher is chosen, in most cases the centrifuge will preferably carry out a positioned stopping so that one of the sides of the stack is substantially at right angles to the feeding device. This ensures good contact at the pushing out, regardless of method, and that the stacks stand in an orderly manner on the discharge conveyor 11.

At positioned stopping of the centrifuge, the distance between the rods 26 of the lifting device 25 can be made substantially smaller than without, as in the former case the side length of the trays has to be able to pass at feeding, while at the non-positioned stopping dimensioning must be in accordance with their diagonal width.

Positioned stopping may be provided, for example, by means of an indicator disc 33 firmly connected with the rotational drive in combination with a sensor 34 detecting when an indicator on the disc 33 is opposite to the sensor. The sensor gives a signal to an electronic motor control unit (not shown), which actuates a brake on the motor and stops it in a predetermined angular position in which the side surfaces of the stack 7 are oriented substantially at right angles to and parallel with the forward direction of the conveyor. To achieve sufficiently accurate stopping without application of excessive control torques, the control for stopping the rotation of the stack is suitably not actuated until the speed of the centrifuge has fallen below a predetermined, relatively low value, which may, for example, be from 1 to 15 percent of the speed at fully active centrifuging. The latter speed may, for example, be in the interval from 400 to 1000 rpm, preferably in the interval from 600 to 800 rpm.

In the embodiment of FIG. 2*c*, the bottom 8 is stationary while the housing 9 is movable. This is of no importance to the fundamental manner in which the centrifuge is filled and emptied, but as the bottom is no longer raised in relation to the holding means, the latter must instead be movable so as not to be in the way of feeding and emptying. This may be achieved, for example, by the holding means being movable downwards through holes in the bottom plate, but there are other solutions as well where, for example, the holding means can be turned to the side or where they can be loosened from the bottom 8 and lifted up together with the housing 9.

The centrifuge can advantageously be used built together with the washing device 2, which can be fed with trays de-stacked from dirty stacks 35 by means of a mechanical de-stacking apparatus, so that a single operator can remove the washed and drained stacks 7 from the conveyor 11 and fill dirty stacks 35 on conveyors 36.

Conveyor as used in this specification means a belt conveyor or a roller table having a row of roll era rotatably journalled in stationary side portions along the conveyor path, or any other supporting surface capable of transporting stacks of egg trays.

Figure 5:
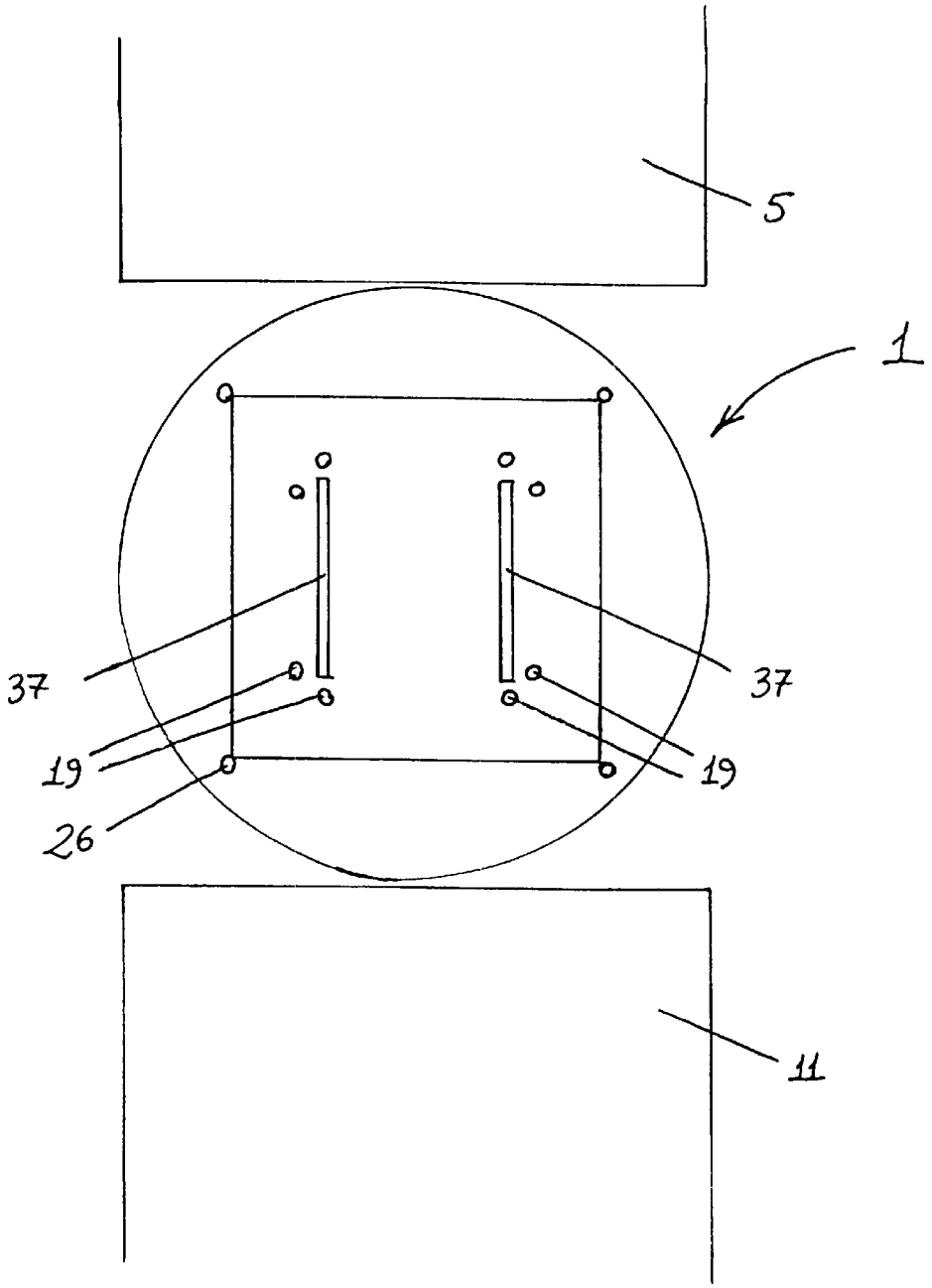
FIG. 5 is a horizontal sectional view through the centrifuge in its closed condition.

FIG. 5, which is a horizontal sectional view through the centrifuge I in its closed condition, shows a preferred embodiment of the holders 19 holding the stack of egg trays locked against rotation in relation to the bottom 8 during centrifuging. The holders are constituted by eight upright rods arranged two by two on respective sides of the four corners of the stack so that the corner tips project between the rods. Obviously, other numbers of holders can also be used. The holders may, for example, be L-shaped and mounted so that the tip of the corners of the stack is placed at the bottom of the associated holders.

FIG. 5 also shows two guide rails 37 which, in the preferred embodiment, are fixed to the bottom 8 as an integral part thereof. When the stacks 7 are pushed into and out of the centrifuge 1, the guide rails 37 act as guides ensuring that the stack 7 is not turned to any substantial extent although it may be exposed to an uneven push. The guide rails 37 also contribute to holding the bottom tray of the stack during centrifuging. It is possible to use the guide rails as the only means of alignment, but they can also be used in combination with the side guides 15.

Details of the various embodiments can be combined into further embodiments within the scope of the present invention.

What is claimed is:

1. A centrifuge for draining washed egg trays and mountable at a feeding conveyor for wet egg trays, said centrifuge comprising a housing with a centrifuge chamber, a bottom having a feeding position in which the bottom is level with the feeding conveyor so that a washed stack of egg trays can be positioned on the bottom, holding means for said stack of egg trays, and a rotational drive for rotating the bottom with said stack of egg trays, said bottom and said housing being mutually displaceable between said feeding position and a centrifuging position enclosed in the centrifuge chamber of the housing, said stack of egg trays being centred on the bottom in the centrifuging position, and said bottom being in engagement with said rotational drive when in said centrifuging position, and said rotational drive being vertically non-displaceable with respect to said housing.

2. A centrifuge according to claim 1, wherein the holding means for the stack of trays rotationally fix the stack to the bottom during centrifuging, and that said holding means are movable in relation to the bottom.

3. A centrifuge according to claim 1, wherein the centrifuge chamber has a cover for upward closing of the chamber, the cover has elongated guides with ends located opposite to the cover, said ends of the elongated guides having carriers for gripping and lifting the bottom.

4. A centrifuge according to claim 3, wherein the carriers are located under the bottom with a clearance up to its lower surface, when the bottom is in the centrifuging position.

5. A centrifuge according to claim 1, wherein the centrifuge is located in a conveyor line between said feeding conveyor and a discharge conveyor, the centrifuge having a feeding opening and a discharge opening, said feeding opening facing sideways and being open towards the feeding conveyor and said discharge opening facing sideways and being open towards the discharge conveyor, when the bottom is in the feeding position.

6. A centrifuge according to claim 5, wherein the feeding conveyor moves the stacks in a forward direction, and wherein the discharge opening and the feeding opening are both aligned with said forward direction.

7. A centrifuge according to claim 1, wherein said centrifuge is associated with a pushing mechanism arranged in connection with the feeding conveyor, which mechanism can push the still wet stack a well-defined distance that positions the stack in an end position which is centred in relation to said bottom.

8. A centrifuge according to claim 1, wherein centring means center the stack of egg trays in the centrifuge in connection with the movement from the feeding position to the centrifuging position.

9. A centrifuge according to the claim 1, wherein a just drained stack of egg trays is pushed out of the centrifuge by means of the next, still wet stack being fed in.

10. A centrifuge according to claim 1, wherein a pusher can push the drained stack out on to the discharge conveyor.

11. A centrifuge according to claim 1, wherein the centrifuge has a stop device that can stop the rotational movement of the bottom at one or more predetermined positions.

12. A centrifuge according to claim 1, wherein there are guides on the bottom for guiding the stack of egg trays during feeding in and pushing out.

13. A centrifuge according to claim 1, wherein said means for holding the trays comprise holders formed as upright rods located in the housing and fixed to a drive shaft in the rotational drive, and wherein in said centrifuging position the upright rods are located at each of the four corners of the stack.

14. A centrifuge according to claim 1, wherein in the centrifuging position the stack is closer to a drive motor of the rotational drive than in the feeding position.

15. A centrifuge according to claim 14, wherein in the centrifuging position a cover closes the centrifuge chamber, which cover is connected to carriers that lift the bottom with respect to the rotational drive during movement from the centrifuging to the feeding position.

16. A centrifuge for draining washed egg trays and mountable at a feeding conveyor for wet egg trays, said centrifuge comprising a housing with a centrifuge chamber, a bottom having a feeding position in which the bottom is level with the feeding conveyor so that a washed stack of egg trays can be positioned on the bottom, holding means for said stack of egg trays, a rotational drive for rotating the bottom with said stack of egg trays, and a cover for closing the centrifuge chamber, said bottom and said housing being mutually displaceable between said feeding position and a centrifuging position, said bottom being in engagement with said rotational drive when in said centrifuging position, said cover being connected to carriers that lift the bottom with respect to the rotational drive during movement from the centrifuging to the feeding position.

17. A centrifuge for draining washed egg trays and mountable at a feeding conveyor for wet egg trays, said centrifuge comprising a housing with a centrifuge chamber, a bottom having a feeding position in which the bottom is level with the feeding conveyor so that a washed stack of egg trays can be positioned on the bottom, a rotational drive for rotating the bottom with said stack of egg trays, said bottom and said housing being mutually displaceable between said feeding position and a centrifuging position, said bottom being in engagement with said rotational drive when in said centrifuging position, and wherein in the centrifuging position the stack is closer to a drive motor of the rotational drive than in the feeding position.

* * * * *